United States Patent [19]

Dupasquier

[11] 4,050,630

[45] Sept. 27, 1977

[54] COMPOSITE ELONGATED STEAM CHAMBER

[76] Inventor: Joseph H. Dupasquier, 5855 NW. Skyline Drive, West Linn, Oreg. 97068

[21] Appl. No.: 601,188

[22] Filed: Aug. 1, 1975

[51] Int. Cl.[2] ..... F26B 21/12; D21F 5/18; B05B 1/28

[52] U.S. Cl. ..... 239/121; 34/210; 34/232; 162/290; 239/553.3; 239/568

[58] Field of Search ..... 239/120–122, 239/553.3, 553.5, 568; 34/210, 212, 218, 221, 223–225, 230–233; 162/290, 308, 359, 375

[56] References Cited

U.S. PATENT DOCUMENTS

| | | | |
|---|---|---|---|
| 3,037,706 | 6/1962 | Dupasquier | 239/120 |
| 3,726,757 | 4/1973 | Dupasquier | 162/308 X |
| 3,777,781 | 12/1973 | Dove | 162/290 X |
| 3,795,578 | 3/1974 | Dupasquier | 162/290 |
| 3,945,881 | 3/1976 | Speidel | 162/290 X |

*Primary Examiner*—John J. Love
*Assistant Examiner*—Andres Kashnikow
*Attorney, Agent, or Firm*—Eugene M. Eckelman

[57] ABSTRACT

Two or more compartments or steam chamber increments are separated by intermediate walls, and headers or conduits lead into such compartments for individually supplying steam thereto. The bottom wall of the compartments has longitudinal slots through the length thereof for discharging steam from the compartments down on a pulp mat. These slots are formed by upwardly and inwardly turned extensions on the side walls of the chamber in combination with one or more V-shaped troughs, and the upper edge portions of these extensions and the troughs have reversely turned ends for supplying rigidity to these members. In one arrangement, horizontal headers or conduits extend in from one end wall of the steam chamber and have steam supplying portions in the respective compartments. These headers are supported in end walls of the compartments, and tubular supports are mounted on the end or intermediate walls to support the inner ends of the headers and allow expansion and contraction of the headers resulting from temperature changes. In another embodiment, a common steam supply header is employed and individual conduits or hoses extend into the compartments. The individual compartments may be of varying length and the steam supplying members are of the necessary size and associated with steam inlet control means to furnish the required volume of steam.

3 Claims, 6 Drawing Figures

COMPOSITE ELONGATED STEAM CHAMBER

BACKGROUND OF THE INVENTION

This invention relates to new and useful improvements in apparatus for applying dried steam down onto a travelling mat in order to aid in the evaporation of water from the pulp mat.

Apparatuses shown in my U.S. Pat. Nos. 3,726,757 and 3,795,578 are directed to a composite steam chamber for applying dried steam down onto a travelling pulp mat. The apparatus of the present invention is similar in concept but has important improvements which make it less expensive to manufacture. The present structure possesses other improved qualities, for example, it is an object thereof to provide better steam coverage for the travelling pulp mat than my prior devices so as to be more readily customized to particular pulp mat conditions. Furthermore, it is an object of the invention to operate with two or more individual compartments or increments and yet achieve a low velocity and uniform steam flow.

SUMMARY OF THE INVENTION

The apparatus comprises a plurality of individual steam compartments or increments disposed in end to end relation so as to form a composite assembly which is arranged to extend transversely over a pulp mat. Steam inlet means are in the form of individual steam supplying headers that in one embodiment extend through end wall means and that have steam supply portions thereof disposed in each of the individual compartments. The conduits have support in said end wall as well as in tubular supports on other walls, the tubular supports allowing expansion and contraction of the headers upon changes of temperature. The bottom wall of the compartments is formed by inward and upward extension means on the side walls of the compartments and parallel longitudinal V-shaped troughs in combination therewith. Upper edge portions of the extensions and troughs are reversely turned to form a rigid structure and adjacent ones of these edges are further reinforced by bar members welded thereacross. Steam supplying header means is also used in a second embodiment, and in each embodiment the size of steam inlet means is related to the size of the steam compartment that it feeds for supplying the required volume of steam. Means also are employed to vary the supply of steam to each compartment for selectively controlling moisture profile on a pulp mat.

The invention will be better understood and additional objects and advantages will become apparent from the following description taken in connection with the accompanying drawings which illustrate preferred forms of the apparatus.

DETAILED DESCRIPTION OF PREFERRED EMBODIMENTS

Figures 1, 2:
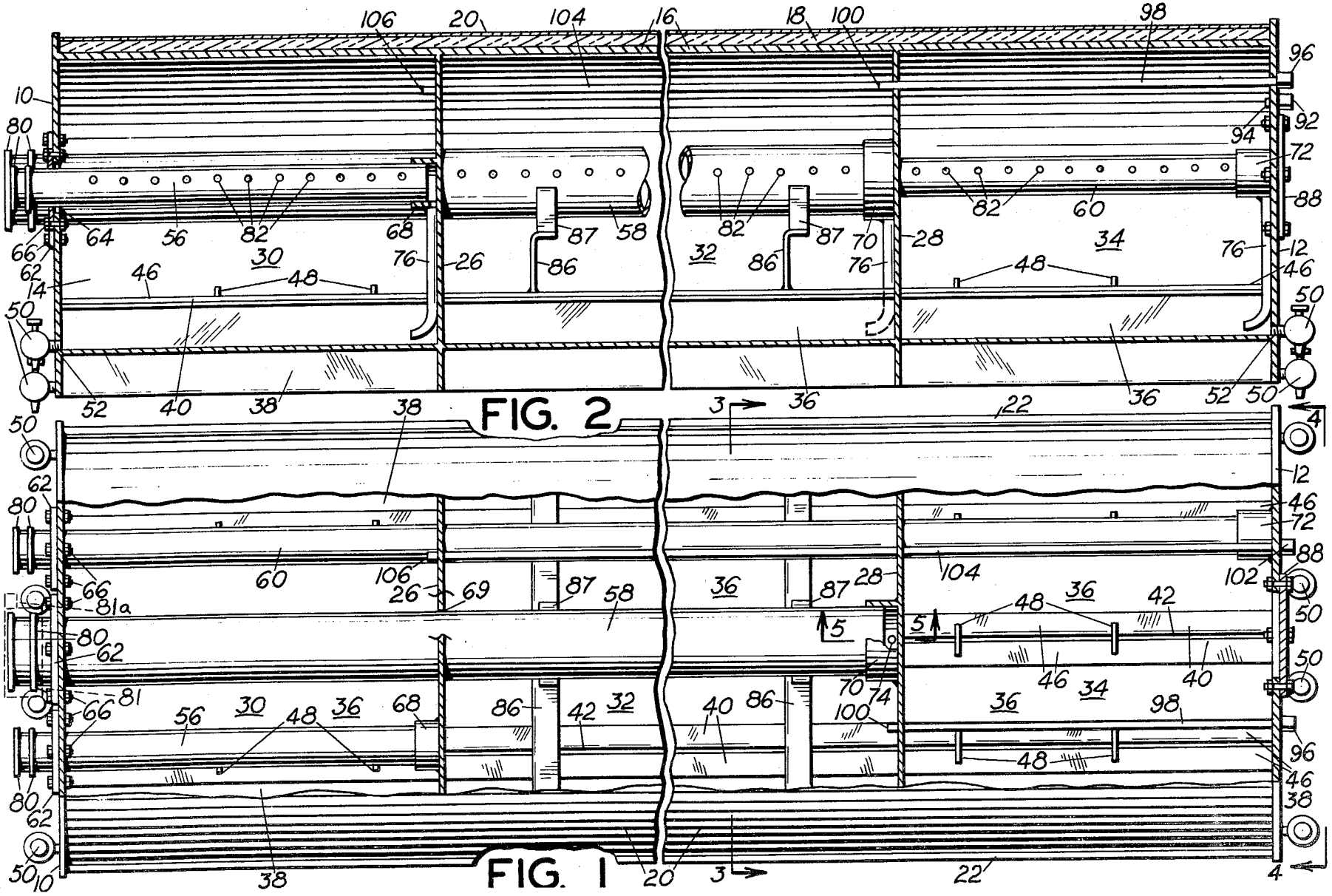
FIG. 1 is a foreshortened top plan view, partly broken away, showing the composite elongated steam chamber of the present invention.
FIG. 2 is a foreshortened vertical sectional view taken on the offset line 2—2 of FIG. 3.
Figure 3:
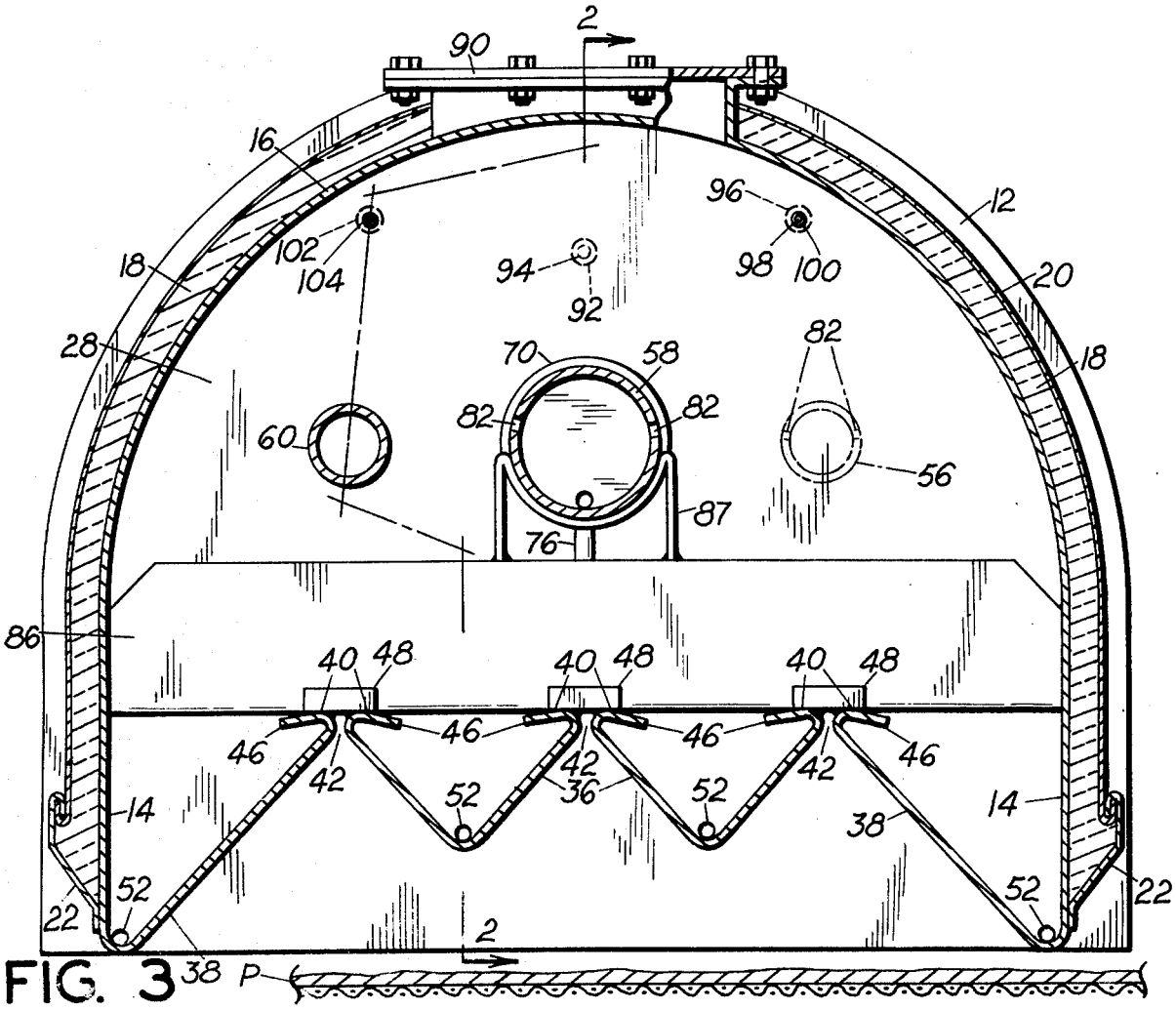
FIG. 3 is an enlarged cross sectional view taken on the line 3—3 of FIG. 1.

With particular reference to the drawings and first to FIGS. 1, 2 and 3, the present composite steam chamber is elongated and has end walls 10 and 12 to which are integrally secured side walls 14. A curved top wall 16 leads upwardly from the side walls. A layer 18 of heat insulating material with an exterior defining skin covering 20 is placed over the top and sides of the chamber, as shown in FIG. 3, the bottom edges of this layer being held by a pair of metal flanges 22 extending the length of the chamber and secured on the outside of the bottom portion of the side walls 14 to hold down the skin covering 20.

The elongated steam chamber has two or more intermediate walls 26 and 28 which extend fully within the inside of the chamber from side to side and down to the bottom of side walls 14 to form separate compartments or steam increments 30, 32 and 34. Although three of such compartments are illustrated in the assembly, it is to be understood that any number of such compartments may be employed and the length thereof, namely, from left to right in FIG. 1 and 2, may be predetermined for selected distribution of steam on a pulp mat, as will be more apparent hereinafter.

The bottom wall of the steam chamber is formed by V-shaped trough sections 36 and inwardly and upwardly disposed full length extensions 38 of the side walls 14, the sections 36 and extensions 38 extending fully between the end walls 10 and 12 and being interrupted only by intermediate walls 26 and 28. Upper edge portions 40 of adjacent ones of the extensions 38 and V-shaped troughs 36 are spaced a slight distance apart and form longitudinal slots 42 through which steam from the chamber is discharged down onto a pulp mat P of a conventional paper-making machine. The upper edge portions 40 of the extensions 38 and troughs are reversely turned into substantially horizontal flange portions 46 which add rigidity to the defining portions of slots 42 to keep the slots of uniform width and thus provide uniform discharge of steam throughout their length and also to prevent chattering or vibration of slot defining portions. To further reinforce and rigidize the structure at the slots 42, small bars 48 are welded across the flange portions 46.

Figure 4:
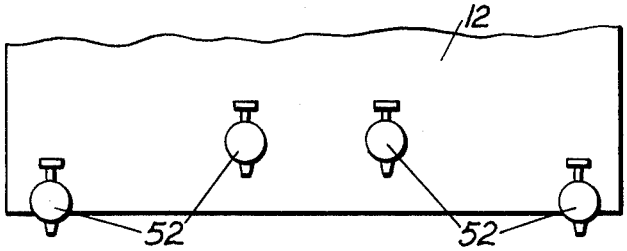
FIG. 4 is a fragmentary end elevational view taken on the line 4—4 of FIG. 1.

The bottoms of troughs 36 and the troughs formed at the bottom of extensions 38 collect water from the steam chamber and have taps 50, also seen in FIG. 4, on the end wall 12 communicating with the bottoms of the troughs through suitable apertures to drain off the water. Intermediate walls 26 and 28 have holes 52 aligned with the bottom of troughs 36 and the bottom of extensions 38 to allow drainage to the taps 50.

Each of compartments 30, 32 and 34 has individual steam supply means in the form of horizontal headers or conduits 56, 58 and 60. Each of these headers leads inwardly from one end, namely, from end wall 10 and each has an integral mounting plate 62 bolted over respective openings 64 in wall 10 as by bolts 66.

The inner end of the header 56 is supported in a tubular member 68 secured integrally as by welding to the intermediate wall 26. Header 58 extends from its mounting plate 62 on wall 10 through compartment 30 and through an aperture 69 in intermediate wall 26 for support at its inner end in a tubular member 70 secured integrally to intermediate wall 28. Header 60 extends from its mounting plate 62 on wall 10 through compartments 30 and 32 and through apertures 69 in both intermediate walls 26 and 28 for support at its inner end in a tubular member 72 secured integrally to the inner surface of end wall 12. Tubular supports 68, 70 and 72 are of internal diameter to firmly support their respective headers but at the same time allow slidable movement therein to allow for expansion and contraction for the headers due to temperature changes. Also the apertures 69 are of selected size to suitably support the respective headers and prevent excessive steam from transferring from one compartment to the other but at the same time they allow expansion and contraction of the headers due to temperatures changes.

Figure 5:
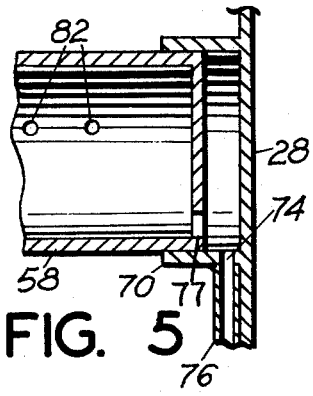
FIG. 5 is an enlarged fragmentary sectional view taken on the line 5—5 of FIG. 1.

Each of the tubular supports 68, 70 and 72 has a drain opening 74, best seen in FIG. 5, adjacent its support on the respective walls and at the lower end thereof, and each of these drain openings communicates with a drain spout 76 located so as to enable any water collecting in the headers to pass down into one of the troughs 36, the spouts being angled laterally to direct the water into the troughs away from the slots. Each of the headers has an outlet port 77 in the inner end thereof for allowing water to drain off.

The headers 56, 58 and 60 are connected to a suitable source of steam, not shown, and the ends thereof that are exterior of wall 10 have quick disconnect portions 80 for ready attachment to the source of steam designated diagramatically by the reference numeral 81 in FIG. 1 having steam inlet control means **81*a* such as valves. Although a steam source 81 and control 81*a* is shown on one header, it is to be understood that individual steam inlet control is provided for each header. Each of the headers 56, 58 and 60 has discharge ports 82 disposed only in the compartment it is to feed, namely header 56 has such ports in compartment 30, header 58 has such ports only in compartment 32, and header 60 has such port only in compartment 34. Preferably, all of these ports are slightly above the horizontal center of the headers on both sides and are directed upwardly to cause good circulation of steam within the compartments prior to discharge downwardly through slots 42**.

As noted in FIGS. 1, 2 and 3, the headers 56, 58 and 60 are of different size and such comprises a present feature of being able to supply the required or desired volume of steam to the respective chambers. That is, it is generally desired that the center compartment or compartments be wider than the side compartments, and since the volume of steam must be greater, to satisfy this larger required output, the header 58 is proportionately larger in diameter to convey a greater volume of steam. Vice versa, since the side compartments usually require a smaller volume of steam than the center compartment, the headers 56 and 60 are smaller in diameter than header 58. The volume of steam admitted to the compartments is controllable by the valve means **81*a*** to control the moisture profile of the pulp mat.

It may be desired to provide auxiliary support for the headers between support points thereof such as for the header 58 in the center compartment 32. For this purpose, one or more upstanding cross plates 86 extend between the side walls 14 and are suitably secured thereto such as by welding. The bottom edges of these cross plates preferably extend across the tops of the reversely turned portions 46 of the troughs 36 and side extensions 38 and are welded thereto for providing additional support for the bottom wall portion. The upper ends of cross plates 86 have cradles 87 mounted on the top thereof, and these cradles support header 58 intermediate wall support points thereof. This type of support may of course be provided for the other headers if desired.

Each of the compartments 30, 32, 34 has an inspection plate 88. Such an inspection plate, FIG. 2, is provided on the end wall 12 for access to compartment 34. The conduit support plates 62 at the other end may comprise inspection plates for the compartment 30, and any intermediate compartment, not being accessible on the ends, is provided with a top inspection plate 90, FIG. 3.

Each of the compartments is provided with a pressure gauge. These gauges are mounted on one of the end walls 10 or 12, preferably 12, which is the front or tending side. A first pressure gauge 92, FIGS. 2 and 3, is mounted in the wall 12 and has a sensing end 94 within the chamber 34. A second pressure gauge 96, also mounted on the wall 12, has an elongated body portion 98 that extends through the compartment 34 and through the intermediate wall 28 and has a sensing end 100 in the compartment 32. Furthermore, a pressure gauge 102, also mounted on the wall 12, has an elongated body portion 104 that passes through compartment 34, intermediate wall 28, compartment 32, and intermediate wall 26 and has a sensing end 106 in the compartment 30.

Figure 6:
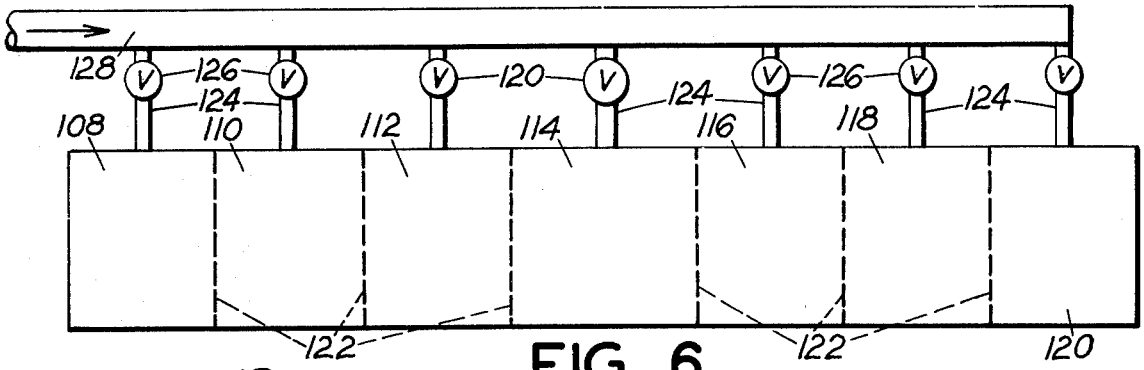
FIG. 6 is a diagrammatic elevation view of a modified form of the invention.

FIG. 6 shows an embodiment of the invention in diagrammatic form. The numerals 108, 110, 112, 114, 116, 118, and 120 designate compartments similar in construction to the compartments 30, 32 and 34 of the first embodiment in that they are separated by intermediate walls, such as walls 122 and utilize the same bottom wall structure, not shown, as in FIG. 3 comprising the troughs 36 and the inward extensions 38 of the side walls. The FIG. 6 embodiment also is similar to the first embodiment in that each compartment has its own inlet means 124, and such inlet means may vary in diameter according to the volume required for the compartment. That is, the center compartment 114, for example, is larger than the other compartments, and the inlet conduit or hose 124 leading into this compartment is larger in diameter than conduits for the other compartments. Each of the conduits 124 has its own separate control valve 126 and these conduits are fed by a common header 128 which receives steam from a suitable source, not shown.

According to the present invention, the steam chamber can be made at a minimum of cost in that it has extremely functional reinforcement from the rounded construction of the upper wall and from the contoured bottom wall in the form of troughs 36 and extensions 38, as well as from cross plates 86. In addition, the various compartments are readily supplied with the desired volume of steam according to the output requirements onto the pulp mat P. The construction of the bottom wall provides for desirable low velocity output, and due to the reinforced rounded defining portions of the slots 42, there is no chatter or vibration from the discharge of steam. The rounded edges also allow a higher capacity of steam to pass through the slots than if the slots were defined by sharp edges. Since the headers 56, 58 and 60 of the first embodiment are all enclosed within the steam chamber and dense insulation 18 is employed, a minimum of noise is present and a minimum of heat loss is present. The noise level is below OSHA requirements. Also according to the structure set forth, the steam chamber does not drip water onto the mat since all the water that may collect therein is caught and drained off. The headers are readily removable endwise by simply unbolting their mounting plate 62 and pulling the header lengthwise from the chamber.

It is to be understood that the forms of my invention herein shown and described are to be taken as preferred examples of the same and that various other changes in the shape, size and arrangement of parts may be resorted to without departing from the spirit of my invention or the scope of the subjoined claims.

Having thus described my invention, I claim:

1. A composite elongated steam chamber arranged to be mounted crosswise over a traveling wet mat and arranged to discharge steam down on the mat, comprising a. elongated top, side, bottom and end walls forming a steam compartment, b. a steam supply conduit leading into said compartment for directing steam into said compartment, c. and means delivering steam to said conduit, d. said bottom wall comprising upwardly and inwardly extending portions from each of said side walls extending the length of said chamber and at least one parallel substantially V-shaped trough also extending the length of said chamber between said inwardly extending portions, e. said inwardly extending portions and said V-shaped trough having adjacent upper terminal ends spaced a slight distance apart to form steam discharging slots extending the length of said chamber, said terminal ends being extended in opposite directions away from said slots and being rounded at said slots for providing rigidity to said inwardly extending portions and to said trough at said discharging slots and also providing quiet and low friction passage of steam therethrough.

2. A composite elongated steam chamber arranged to be mounted crosswise over a traveling wet mat and arranged to discharge steam down on the mat, comprising a. elongated top, side, bottom and end walls, b. at least one intermediate wall between said end walls forming separate steam compartments, c. a first horizontal conduit having opposite ends and extending in supported relation through one of said end walls and through said steam compartments, d. means supporting the other end of said first conduit in the other end wall, e. said first conduit having steam supply outlet means for one of said compartments, f. a second horizontal conduit having opposite ends and extending in supported relation through the same end walls as said first conduit and through one only of said steam compartments, g. said second conduit terminating at its other end at said intermediate wall, h. means on said intermediate wall supporting said other end of said second conduit, i. said support means supporting said second conduit in a slidable arrangement to allow expansion and contraction of said conduit as a result of temperature changes, j. said second conduit having steam supply outlet means for the other compartment, k. and means at one end of said steam compartment for delivering steam to each of said conduits, l. said bottom wall comprising upwardly and inwardly extending portions from each of said side walls extending the length of said chamber and at least one parallel substantially V-shaped trough also extending the length of said chamber between said inwardly extending portions, m. said inwardly extending portions and said V-shaped trough having adjacent upper terminal ends spaced a slight distance apart to form steam discharging slots extending the length of said chamber, n. said terminal ends being extended in opposite directions away from said slots and being rounded at said slots for providing rigidity to said inwardly extending portions and said trough at said steam discharging slots and also providing low friction passage of steam therethrough.

3. The composite steam chamber of claim 2 including crossbars secured to adjacent rounded end portions of said extensions and said trough to reinforce said extensions and trough.

* * * * *